US010522942B2

(12) United States Patent
Tsai

(10) Patent No.: US 10,522,942 B2
(45) Date of Patent: Dec. 31, 2019

(54) SECURING MODULE

(71) Applicant: PEGATRON CORPORATION, Taipei (TW)

(72) Inventor: Cheng-En Tsai, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/276,845

(22) Filed: Feb. 15, 2019

(65) Prior Publication Data

US 2019/0312379 A1 Oct. 10, 2019

(30) Foreign Application Priority Data

Apr. 9, 2018 (TW) ..... 107112187 A

(51) Int. Cl.

| | |
|---|---|
| ***H01R 13/72*** | (2006.01) |
| ***H01R 13/58*** | (2006.01) |
| ***H01R 4/42*** | (2006.01) |
| ***H01R 13/621*** | (2006.01) |
| ***H01R 13/627*** | (2006.01) |
| ***H01R 13/52*** | (2006.01) |
| ***H01R 13/639*** | (2006.01) |

(52) U.S. Cl.

CPC ..... *H01R 13/5812* (2013.01); *H01R 4/42* (2013.01); *H01R 13/5213* (2013.01); *H01R 13/621* (2013.01); *H01R 13/6278* (2013.01); *H01R 13/6395* (2013.01)

(58) Field of Classification Search

CPC ..... H01R 13/72; H02B 1/202; H04Q 1/14; H01B 7/06

USPC ..... 439/501; 361/686, 826, 827; 174/69

See application file for complete search history.

(56) References Cited

U.S. PATENT DOCUMENTS 5,769,514 A * 6/1998 Brown ..... A47B 3/08 108/129
6,471,542 B1 * 10/2002 Comer ..... H01R 13/72 439/501
6,945,412 B2 * 9/2005 Felcman ..... H05K 7/1494 211/175

FOREIGN PATENT DOCUMENTS

TW M365587 U1 9/2009
TW M524814 U 7/2016

* cited by examiner

*Primary Examiner* — Phuong Chi Thi Nguyen
(74) *Attorney, Agent, or Firm* — McClure, Qualey & Rodack, LLP

(57) ABSTRACT

A securing module includes a positioning member, a fixing member, a wire management member, and a cover. The positioning member is disposed on a case. The fixing member is passed through the positioning member and fixed to the case. The wire management member is disposed on the fixing member. The cover is assembled to the case. The cover includes at least one hook, a clamping component, and a hollow shell. The at least one hook and the clamping component are disposed on the hollow shell. The hollow shell covers the positioning member, the fixing member, and the wire management member. The clamping component is selectively moved between a fixing position and a releasing position. When the at least one hook is snap-fit to the case and the clamping component is located at the fixing position, the clamping component clamps the positioning member so that the hollow shell is fixed to the case.

9 Claims, 8 Drawing Sheets

SECURING MODULE

CROSS-REFERENCE TO RELATED APPLICATION

This non-provisional application claims priority under 35 U.S.C. § 119(a) to Patent Application No. 107112187 filed in Taiwan, R.O.C. on Apr. 9, 2018, the entire contents of which are hereby incorporated by reference.

BACKGROUND

Technical Field

The application relates to a securing module, and in particular, to a securing module preventing a wire from being pulled out.

Related Art

In various servers, players, or external electronic devices, to implement functions such as connecting to a power supply, receiving signals, or transmitting signals, a required connector is generally disposed on a side of a case, and wires such as a power cable, a signal cable, or a transmission line are plugged in during use. When connected, the wires are generally exposed directly, or a hub is used to manage the wires.

Some external electronic devices such as set-top boxes of televisions, external hard disks, and portable projectors are relatively small. These goods are generally placed at a fixing position for use, and are relatively easy to be pushed away from an original position after impacted by an external force. Wires of such goods are generally exposed to the outside of the electronic devices and no protective measures are applied. Therefore, f exposed wires and various electronic devices if the wires are accidentally kicked or the electronic devices are hit, the wires may be disconnected from the electronic devices, resulting in problems such as shutdown of the electronic devices (for a power cable) or interruption of signal transmission (for a signal cable).

SUMMARY

In view of this, an embodiment of the application provides a securing module applied to a case, and includes a positioning member, a fixing member, a wire management member, and a cover. The positioning member is disposed on the case. The fixing member is passed through the positioning member and fixed to the case. The wire management member is disposed on the fixing member, and the wire management member includes an accommodating groove for accommodating a wire. The cover is assembled to the case. The cover includes at least one hook, a clamping component, and a hollow shell. The at least one hook and the clamping component are disposed on the hollow shell. The hollow shell covers the positioning member, the fixing member, and the wire management member. The clamping component is selectively moved between a fixing position and a releasing position. When the at least one hook is snap-fit to the case and the clamping component is located at the fixing position, the clamping component clamps the positioning member so that the hollow shell is fixed to the case.

In some embodiments, the fixing member includes a body, a clamping portion, and an engaging groove. The body is passed through the positioning member and fixed to the case, and the clamping portion and the engaging groove are connected to the body. The wire management member further includes a buckle portion and an engaging portion. The buckle portion is rotatably buckled to the clamping portion, and the wire management member is rotated so that the engaging portion is placed in the engaging groove.

In some embodiments, the fixing member and the wire management member may alternatively be an integrally formed structure.

In some embodiments, the at least one hook is an L-shaped hook, and the case has at least one through hole, and the at least one hook runs through the corresponding at least one through hole and moves toward a first direction, so that the at least one hook is snap-fit to the case, and the hollow shell is fixed to the case.

In some embodiments, the clamping component includes a pushing member and a clamping member. The hollow shell includes a guide track. The pushing member runs through the guide track and abuts against the clamping member. The pushing member is selectively moved between the fixing position and the releasing position, and drives the clamping member to move so that the clamping member clamps or is detached from the positioning member.

In some embodiments, the clamping member has two clamping portions disposed in parallel. When the clamping member correspondingly clamps the positioning member, the two clamping portions respectively clamp two opposite sides of the positioning member to restrict movement of the hollow shell in the first direction.

In some embodiments, the fixing member includes a body and a limiting hole, and the hollow shell has a locking hole. When the cover is assembled to the case, the locking hole corresponds to the limiting hole. Alternatively, in some embodiments, the securing module may further include a limiting member, where the limiting member runs through the locking hole and the limiting hole, and rotates relative to the fixing member and the hollow shell, so that the limiting member can incomplete overlap the locking hole and the limiting hole, to fix the hollow shell and the fixing member.

In some embodiments, the hollow shell includes an opening and a wire outlet, the opening and the wire outlet are located on two opposite end faces of the hollow shell, the at least one hook is disposed on the end face the same as the end face on which the opening is located, and the wire is accommodated in the accommodating groove and runs through the wire outlet.

In conclusion, after the wire connected to the case is accommodated and fixed by using the wire management member, even if the wire is pulled by an external force or the case is impacted, the wire management member may first bear the external force rather than the connection between the wire and the case, so that the wire and the case are not easily detached from each other, avoiding shutdown of an electronic device without warning or lose of a connection signal due to detachment of the wire from the case.

Moreover, the cover is assembled to the case, so that a connection end between the wire and the case can be hidden in the cover. In addition, the cover can be snap-fit to the case by using the hook disposed on the hollow shell to achieve fixing and limiting in a direction perpendicular to the first direction, that is, the hollow shell cannot be directly detached from the case by applying a force in the direction perpendicular to the first direction. Then, the clamping component moves to the fixing position so that the clamping component clamps the positioning member to achieve fixing and limiting in a direction parallel to the first direction, so that the hollow shell cannot be directly detached from the case by applying a force in the first direction.

The detailed features and advantages of the application are described in detail below in the embodiments, which is sufficient to enable any person skilled in the art to understand the technical contents of the application, and it is easy for any person skilled in the art to understand the objective and advantages of the application according to the disclosure, the protection scope of the claim, and the drawings of the specification.

DETAILED DESCRIPTION OF THE EMBODIMENTS

Figure 1:
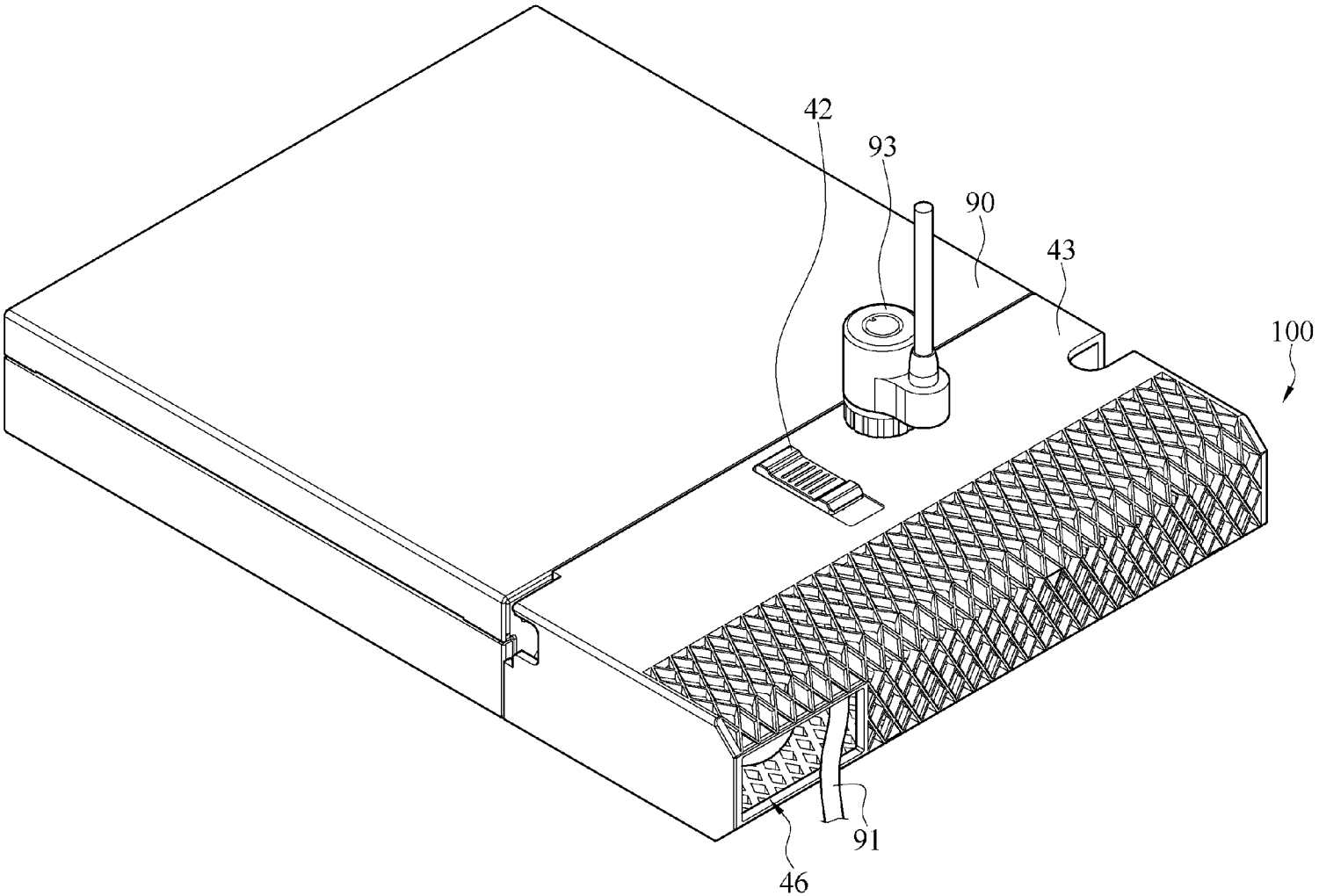
FIG. 1 is a schematic diagram of a securing module after assembled according to an embodiment of the application.
Figure 2:
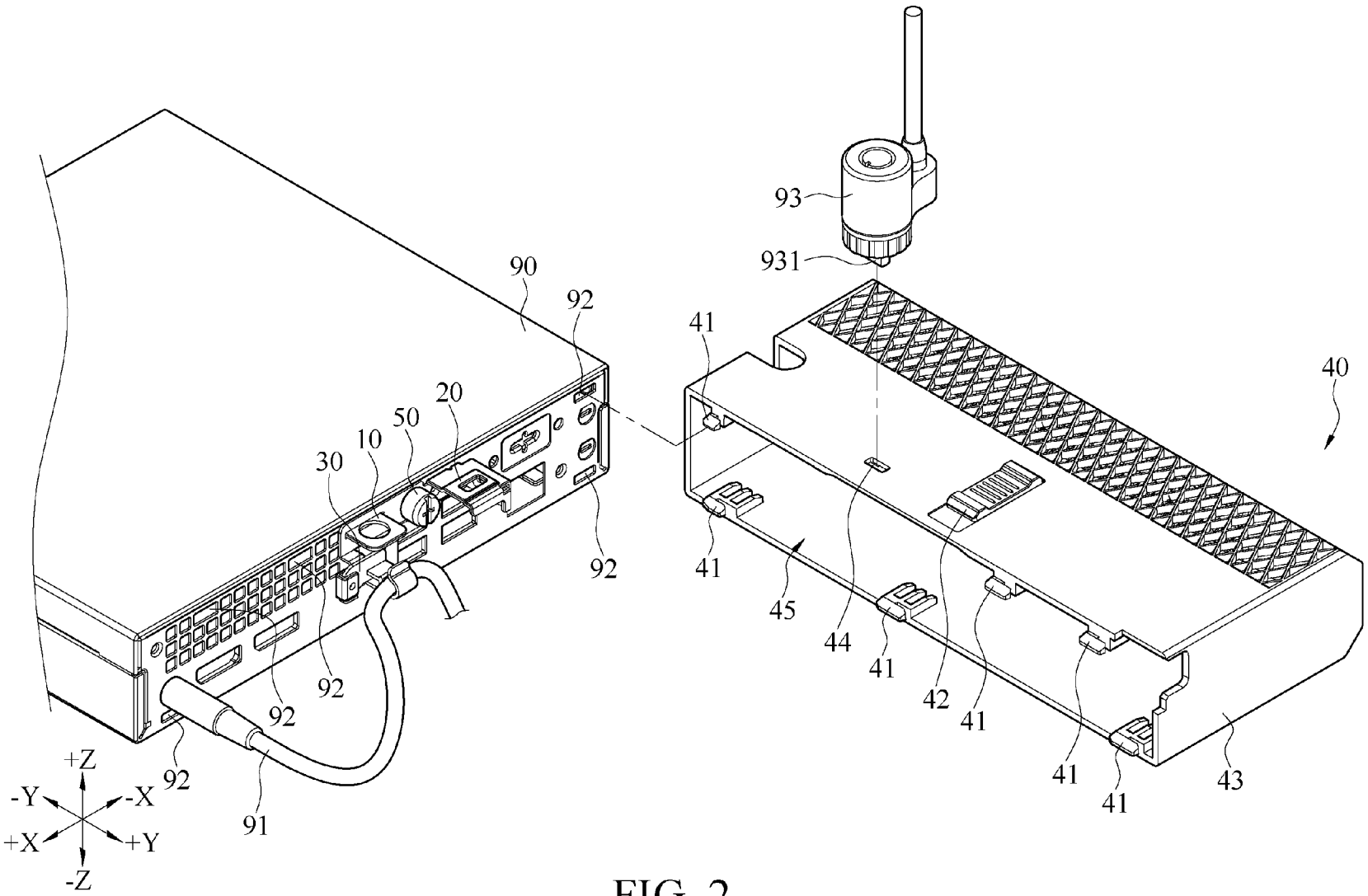
FIG. 2 is a first schematic exploded view of a securing module according to an embodiment of the application.
Figure 3:
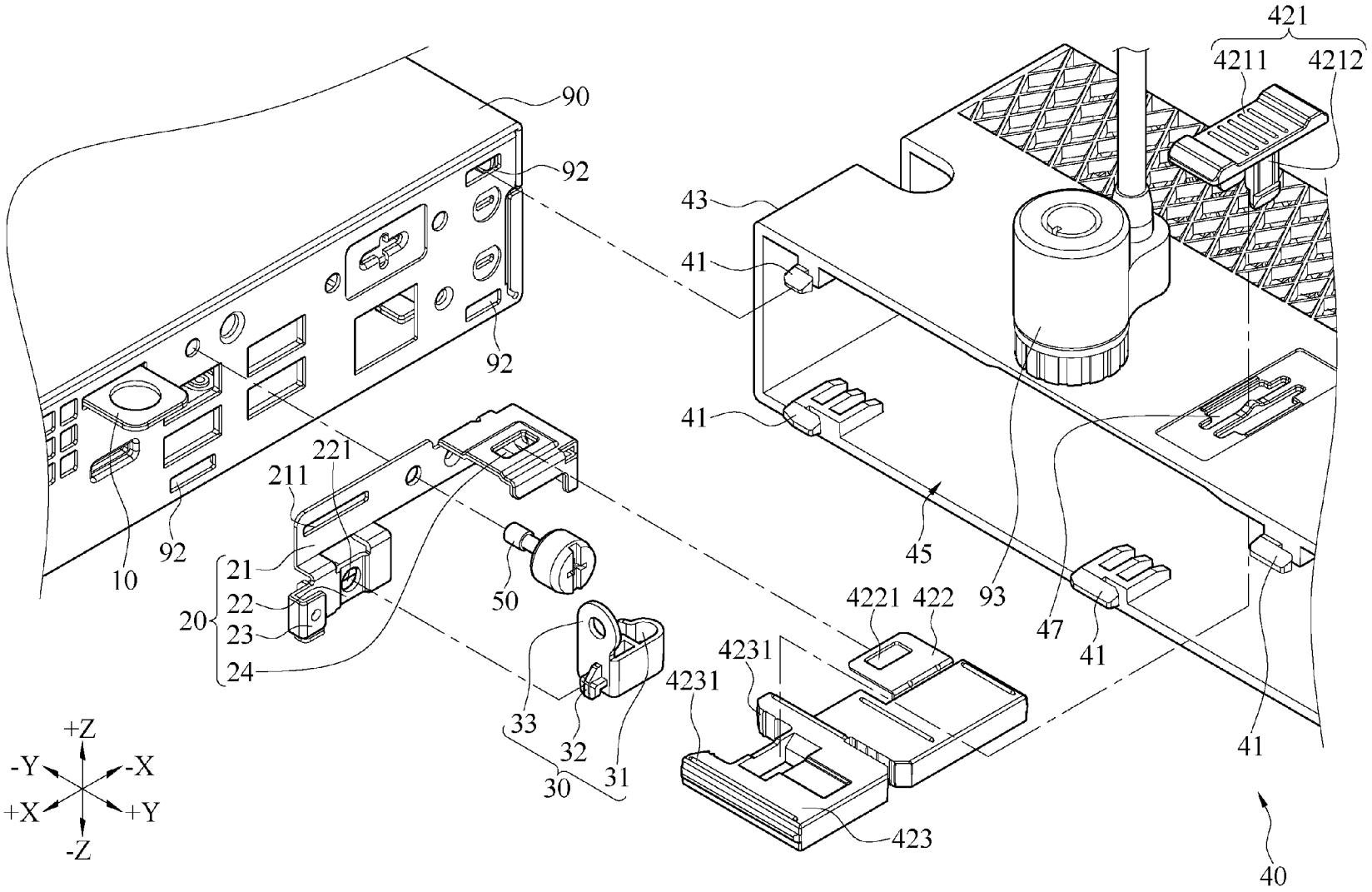
FIG. 3 is a second schematic exploded view of a securing module according to an embodiment of the application.
Figure 4:
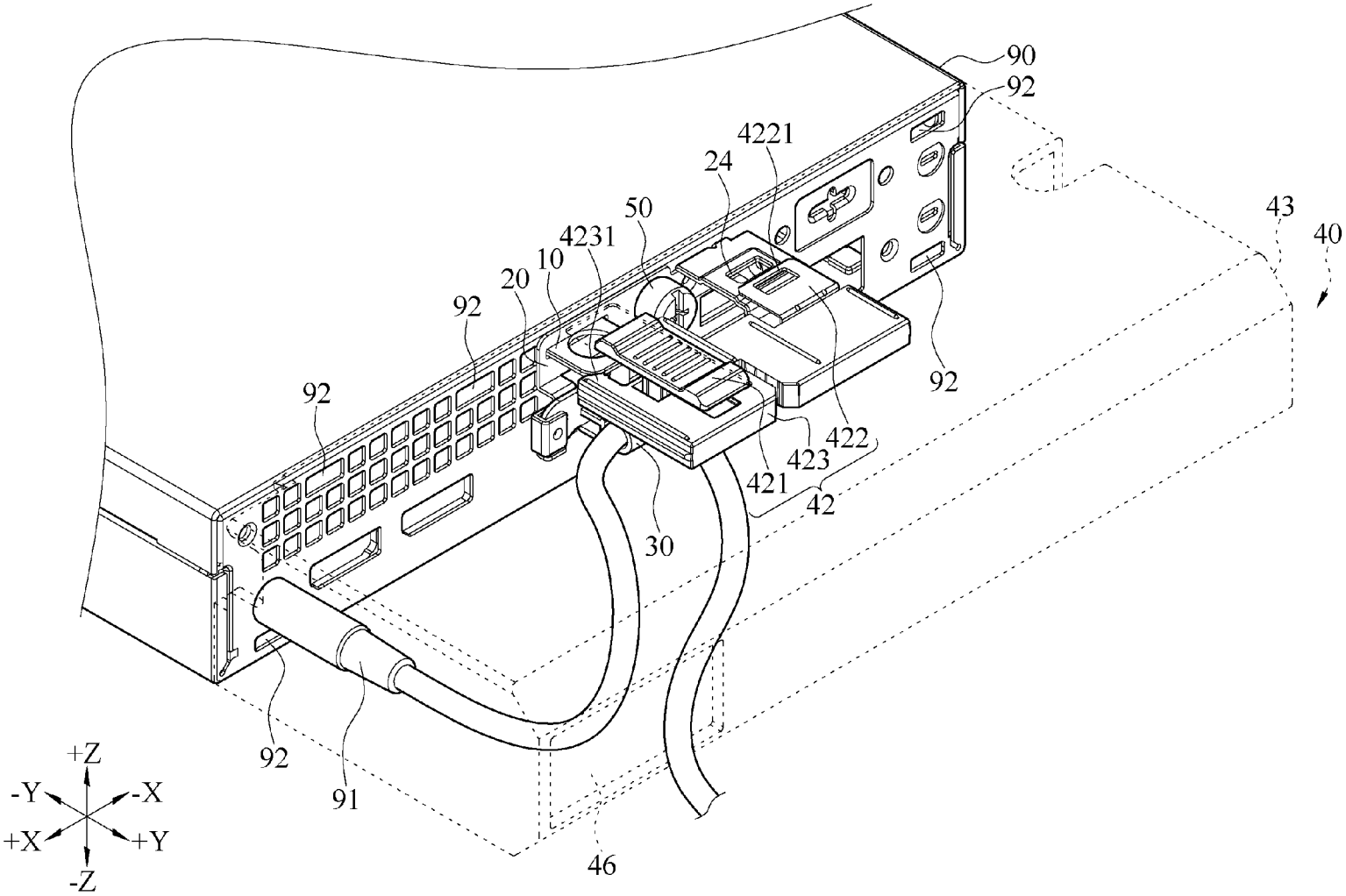
FIG. 4 is a partial perspective schematic view of a clamping component at a releasing position according to an embodiment of the application.
Figure 5:
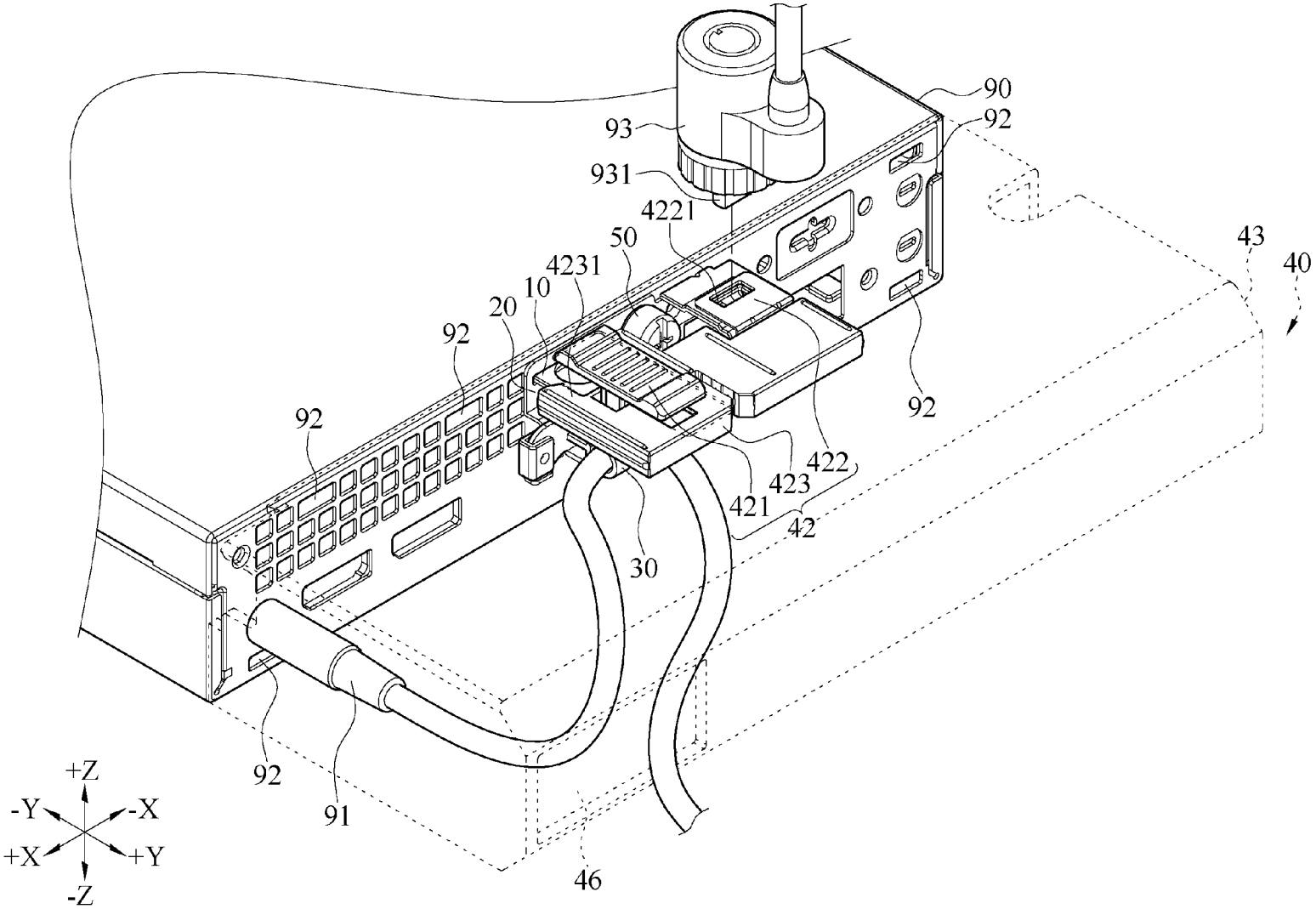
FIG. 5 is a partial perspective schematic view of a clamping component at a fixing position according to an embodiment of the application.

Referring to FIG. 1 to FIG. 5 together, FIG. 1 is a schematic diagram of a securing module after assembled according to an embodiment of the application, FIG. 2 is a first schematic exploded view of a securing module according to an embodiment of the application, FIG. 3 is a second schematic exploded view of a securing module according to an embodiment of the application, FIG. 4 is a partial perspective schematic view of a clamping component at a releasing position according to an embodiment of the application, and FIG. 5 is a partial perspective schematic view of a clamping component at a fixing position according to an embodiment of the application. A securing module 100 in this embodiment includes a positioning member 10, a fixing member 20, a wire management member 30, and a cover 40. As shown in FIG. 3, the positioning member 10 is disposed on a case 90. In this embodiment, the positioning member 10 extends from the inside of the case 90 to the outside of the case 90. In another implementation, the positioning member 10 and the case 90 may alternatively be of an integrally formed structure, and the application is not limited thereto.

The fixing member 20 is passed through the positioning member 10 and fixed to the case 90. The wire management member 30 is disposed on the fixing member 20, and the wire management member 30 includes an accommodating groove 31 for accommodating a wire 91. As shown in FIG. 2, after the wire 91 is connected to the case 90, the wire 91 may be disposed at the wire management member 30. It can be learned based on this that, the accommodating groove 31 is disposed close to the case 90, and a direction in which the accommodating groove 31 is disposed is perpendicular to a direction in which the wire 91 is connected to the case 90. In addition, the wire 91 runs through and is accommodated in the accommodating groove 31, so that the wire 91 is bent and extends to be laid on the cover 40, to enhance fixing of the wire 91 close to the case 90 and prevent the wire 91 from being pulled and easily detached from the case 90. For example, when the wire 91 is pulled by an external force, the wire management member 30 may first bear the external force rather than a connection between the wire 91 and the case 90, so that the wire 91 and the case 90 are not easily detached from each other, avoiding shutdown of an electronic device without warning or lose of a connection signal due to detachment of the wire 91 from the case.

As shown in FIG. 1 and FIG. 2, the cover 40 is assembled to the case 90, and covers the positioning member 10, the fixing member 20, and the wire management member 30. The cover 40 is assembled after the wire 91 is mounted, so that the connection between the wire 91 and the case 90 is also covered within the cover 40.

Further, it can be learned in FIG. 2 that the cover 40 includes at least one hook 41, a clamping component 42, and a hollow shell 43. In this embodiment, an example in which six hooks 41 are disposed is used for description, but the number of the hooks 41 may be set as required, and the application is not limited thereto. It can be learned in FIG. 1 to FIG. 5, the six hooks 41 and the clamping component 41 are disposed on the hollow shell 43. The hooks 41 are correspondingly snap-fit to the case 90, and the hollow shell 43 covers the positioning member 10, the fixing member 20, and the wire management member 30. The clamping component 42 may be selectively moved between a fixing position (as shown in FIG. 5) and a releasing position (as shown in FIG. 4). When the hooks 41 are snap-fit to the case 90 and the clamping component 42 is located at the fixing position, the clamping component 42 clamps the positioning member 10 so that the hollow shell 43 is fixed to the case 90. More specifically, the cover 40 is snap-fit to the case 90 by using the hooks 41, and after the clamping component 42 is pushed to the fixing position, the clamping component 42 clamps the positioning member 10, so that the hollow shell 43 is fixed to the case 90 to prevent the cover 40 from being easily removed due to an external force.

The cover 40 is assembled to the case 90, so that a connection end between the wire 91 and the case 90 can be hidden in the cover 40. In addition, the cover 40 is snap-fit to the case 90 by using the hooks 41 disposed on the hollow shell 43 to achieve fixing and limiting in a direction perpendicular to a first direction, that is, the hollow shell 43 cannot be directly detached from the case 90 by applying a force in the direction perpendicular to the first direction. Then, the clamping component 42 is pushed to the fixing position, so that the clamping component 42 clamps the positioning member 10 to achieve fixing and limiting in a direction parallel to the first direction, the hollow shell 43 cannot be directly detached from the case 90 by applying a force in the direction parallel to the first direction, and the hollow shell 43 is not easily separate from the case 90.

Next, an implementation of detailed structures of the fixing member 20 and the wire management member 30 is described. Referring to FIG. 3, in this embodiment, the fixing member 20 includes a body 21, a clamping portion 22, and an engaging groove 23. The body 21 has a first hole 211. The first hole 211 of the body 21 is correspondingly passed through the positioning member 10, and fixes the fixing member 20 to the case 90. In this embodiment, a locking element 50 (such as a screw) may run through the body 21 and then lock the body 21 to the case 90 so that the fixing member 20 is fixed to the case 90 (as shown in FIG. 2). In another implementation, the fixing member 20 may alternatively be integrally formed on the case 90 without locking with the additional locking element 50.

Returning to FIG. 3, the clamping portion 22 and the engaging groove 23 of the fixing member 20 are both connected to the body 21. The clamping portion 22 has a second hole 221, and the engaging groove 23 is located close to the second hole 221. The wire management member 30 further includes a buckle portion 32 and an engaging portion 33. The buckle portion 32 separately extends to the accommodating groove 31 and the engaging portion 33. After the buckle portion 32 is rotatably buckled to the clamping portion 22, the wire management member 30 is rotated, so that the engaging portion 33 is placed in the engaging groove 23 (as shown in FIG. 7).

Figure 6:
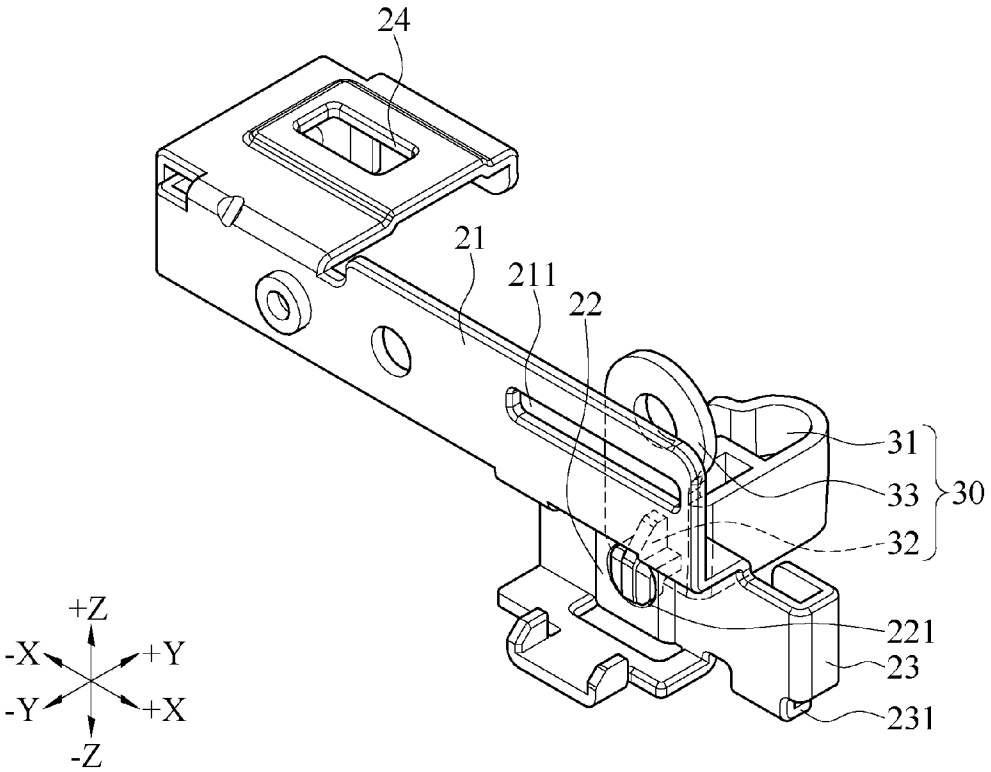
FIG. 6 is a partial perspective view of assembly of a wire management member according to an embodiment of the application.
Figure 7:
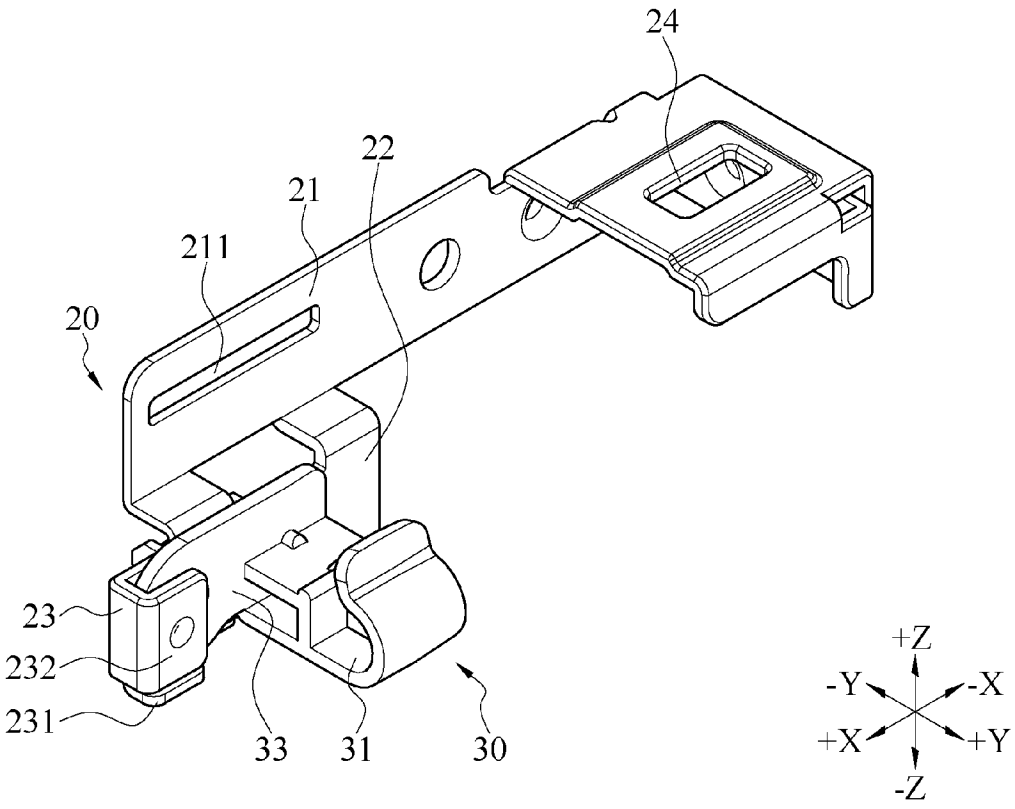
FIG. 7 is a schematic diagram of assembly of a wire management member according to an embodiment of the application.
Figure 8:
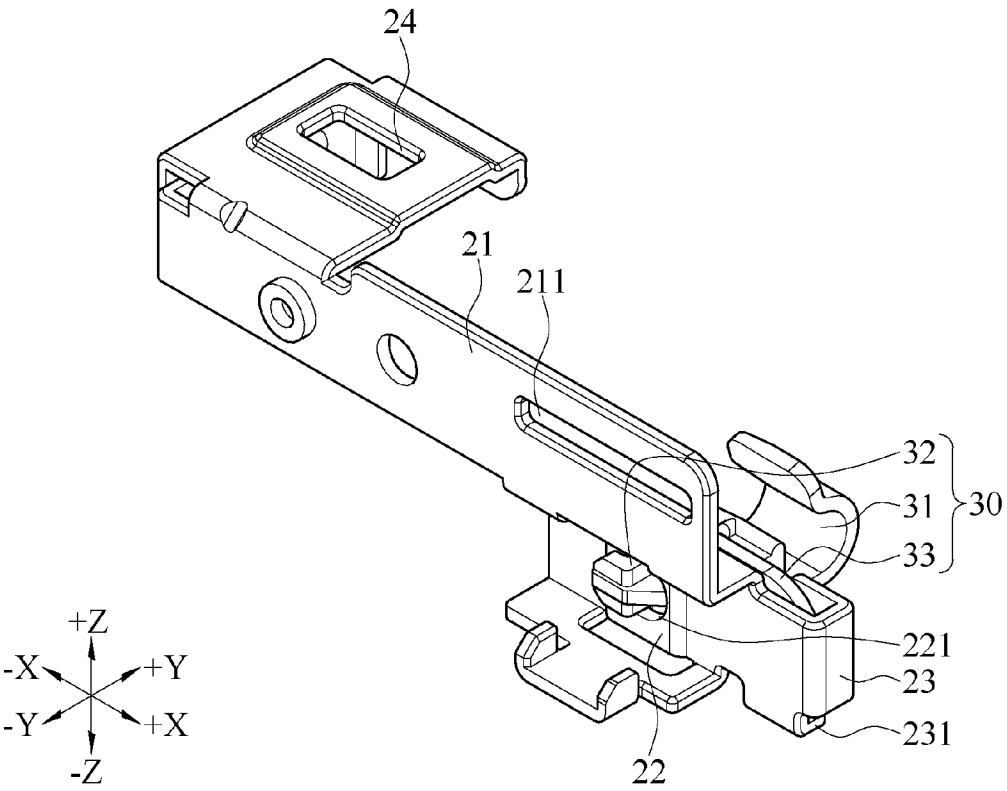
FIG. 8 is a schematic diagram of an assembled wire management member at another perspective according to an embodiment of the application.

More specifically, referring to FIG. 3 and FIG. 6 to FIG. 8 together, FIG. 6 is a partial perspective view of assembly of a wire management member according to an embodiment of the application, FIG. 7 is a schematic diagram of assembly of a wire management member according to an embodiment of the application, and FIG. 8 is a schematic diagram of an assembled wire management member at another perspective according to an embodiment of the application. Herein, for ease of description, a +X-axis direction indicated in the figures is considered as the first direction, a +Y-axis direction is considered as a second direction, a +Z-axis direction is considered as a third direction, a −X-axis direction is considered as a fourth direction, a −Y-axis direction is considered as a fifth direction, and a −Z-axis direction is considered as a sixth direction. The coordinate-axis directions are merely used for description, and directions in the application are not limited thereto. The first direction, the second direction, and the third direction (that is, the +X axis, the +Y axis, and the +Z axis) are perpendicular to each other, and the fourth direction, the fifth direction, and the sixth direction (that is, the −X axis, the −Y axis, and the −Z axis) are perpendicular to each other. The first direction and the fourth direction are two opposite directions in a same axial direction as well as the second direction and the fifth direction, and the third direction and the sixth direction. When the wire management member 30 is assembled to the fixing member 20, the wire management member 30 is rotated until the engaging portion 33 is in the +Z-axis direction (that is, toward the top of the figure) and the buckle portion 32 is in the −Z axis direction. After the buckle portion 32 is rotatably buckled to the engaging portion 22 (as shown in FIG. 6), the wire management member 30 is subsequently rotated so that the engaging portion 33 is placed in the accommodating groove 23 (as shown in FIG. 7), that is, the wire management member 30 is rotated by 90 degrees until the engaging portion 33 is in the +X-axis direction (that is, toward the left of FIG. 7) and the buckle portion 32 is in the −X axis direction, so that the wire management member 30 can be fixed to the fixing member 20.

It can be learned in FIG. 3 that, the buckle portion 32 of the wire management member 30 is approximately an L-shaped hook structure, and referring to FIG. 6 together, it can be learned that there is an inclined portion on a side of the L-shaped hook structure. As shown in FIG. 6, after the buckle portion 32 is passed through the second hole 221, the inclined portion abuts against a periphery of the second hole 221. The buckle portion 32 is slightly moved toward the −Z-axis direction, so that the buckle portion 32 of the L-shaped hook structure is rotatably buckled to the periphery of the second hole 221. Further, as shown in FIG. 8, after rotating, the L-shaped hook structure of the buckle portion 32 is still hooked on the periphery of the second hole 221 to achieve a stop function in the +Y-axis direction.

Referring to FIG. 7, the engaging groove 23 has a base plate 231 in the −Z-axis direction, and has a front stop blade 232 on a side relatively close to the +Y-axis direction. When the wire management member 30 rotates as shown in FIG. 7 so that the engaging portion 33 is engaged in the engaging groove 23, the base plate 231 can stop the engaging portion 33 of the wire management member 30 so that the engaging portion 33 is positioned in the engaging groove 23. The front stop blade 232 can achieve a stop function in the +Y-axis direction. In this way, when the wire management member 30 is impacted by a force in the +Y-axis direction, besides a snap-fit effect achieved by the buckle portion 32 as described above, the front flap 232 can also achieve a stop effect to prevent the wire management member 30 from being easily detached from the fixing member 20 due to an instantaneously excessive force.

In addition, in this embodiment, the wire management member 30 is assembled to the fixing member 20 through snap-fit and rotation. However, in another implementation, the wire management member 30 and the fixing member 20 may alternatively be in an integrally formed structure. In this way, it can also be ensured that the wire management member 30 is not easily detached from the fixing member 20. Next, an example of detailed structures of the cover 40 and the case 90 is further described. As shown in FIG. 2, in this embodiment, the six hooks 41 are L-shaped hooks, and the case 90 has at least one through hole 92 whose number is the same as that of the hooks 41. When the cover 40 is correspondingly assembled to the case 90, and after the hooks are passed through the corresponding through holes 92 and moved toward the +X-axis direction (that is, the first direction), the hooks are snap-fit to the case 90. In other words, the L-shaped hooks 41 are snap-fit to a wall of the case 90. In this way, when impacted by a force in the direction perpendicular to the first direction (such as the +Y-axis direction, the −Y-axis direction, the +Z-axis direction, or the −Z-axis direction), the cover 40 is not easily detached from the case 90 under the fastening function of the hooks 41. When the cover 40 needs to be removed, the cover 40 is first moved toward the −X-axis direction so that the hooks 41 are detached from the wall. In this case, the force in the +Y-axis direction is applied, and the cover 40 can be removed.

Next, referring to FIG. 3 to FIG. 5 together, the clamping component 42 includes a pushing member 421 and a clamping member 423, where the clamping member 423 is disposed on an inner side face of the hollow shell 43, and the pushing member 421 is assembled to the outside of the hollow shell 43 and is passed through the hollow housing 43 to connect to the clamping member 423. The pushing member 421 is disposed on an outer side face of the hollow shell 43 to facilitate an operation of selectively moving the pushing member 421 relative to the hollow shell 43 between the fixing position (as shown in FIG. 5) and the releasing position (as shown in FIG. 4), and drives the clamping member 423 to move so that the clamping member 423 clamps or is detached from the positioning member 10. It can be learned in FIG. 3 that, the pushing member 421 has an operating portion 4211 and a pushing portion 4212, where the pushing portion 4212 is connected to the operating portion 4211. Herein, the pushing portion 4212 is disposed perpendicular to the operating portion 4211, and extends toward the −Z-axis direction (below the figure).

Referring to FIG. 2 and FIG. 3 together, the cover 40 has a guide track 47. When the pushing member 421 is assembled to the hollow shell 43, the pushing portion 4212 of the pushing member 421 extend to an inner side of the hollow shell 43 through the guide track 47, runs through the clamping member 423 disposed on the inner side of the hollow shell 43 and abuts against the bottom of the clamping member 423. In this way, when a force is applied to the operation portion 4211, the pushing portion 4212 and the clamping member 423 connected to the pushing portion 4212 are driven to move together, so that the clamping member 423 clamps the positioning member 10 (as shown in FIG. 5) or is away from the positioning member 10 (as shown in FIG. 4). In addition, the guide track 47 may also be used for limiting so that the pushing member 421 can move only within a range of the guide track 47.

Referring to FIG. 3, the clamping member 423 has two clamping portion 4231 disposed in parallel, and an accommodating space is formed between the two clamping portions 4231. When the pushing member 421 is located at the releasing position (as shown in FIG. 4), a position of the clamping member 423 corresponds to a position of the positioning member 10. When the pushing member 421 is moved to the fixing position relative to the hollow shell 43 (as shown in FIG. 5), the two clamping portion 4231 of the clamping portion 423 are driven to move to two opposite sides of the positioning member 10, and the two clamping portion 4231 respectively clamp the two opposite sides of the positioning member 10, so that the positioning member 10 is located in the accommodating space, to clamp the positioning member 10 to achieve limiting and stop functions in the direction parallel to the first direction.

Therefore, when the cover 40 is assembled to the case 90 simply in the aforementioned assembly manner of the hooks 41, if the cover 40 needs to be removed, the cover 40 needs to be moved toward the −X-axis direction first, so that the cover 40 can be moved toward the +Y-axis direction to be removed. However, after the cover 40 is mounted to the case 90 in the aforementioned assembly manner of the hooks 41, and when the pushing member 421 is moved from the releasing position to the fixing position, as shown in FIG. 5, in this case, the two clamping portions 4231 respectively clamp the two opposite sides of the positioning member 10. Therefore, the positioning member 10 is clamped and stopped by using the clamping portion 4231, so that the cover 40 at least cannot move in the direction parallel to the first direction (that is, the +X-axis direction and the −X-axis direction).

Further, to better strengthen the connection between the cover 40 and the case 90 and prevent the cover 40 from being easily detached or falling off after impacted by a force, in this embodiment, the clamping component 42 may further include a reinforcing sheet 422. The reinforcing sheet 422 is also disposed on the inner side of the hollow shell 43. In this embodiment, the reinforcing sheet 422 is connected to the clamping member 423, so that when the pushing member 421 drives the clamping member 423 to move relative to the hollow shell 43, the reinforcing sheet 422 is together driven to move.

Referring to FIG. 3 to FIG. 5, in this embodiment, the fixing member 20 further includes a limiting hole 24, and the hollow shell further includes a locking hole 44. When the cover 40 is assembled to the case 90, a position of the locking hole 44 corresponds to a position of the limiting hole 24, as shown in FIG. 3. Next, when the clamping component 42 is moved to the fixing position, the reinforcing sheet 422 correspondingly overlaps between the limiting hole 24 and the locking hole 44, and a hollow portion 4221 of the reinforcing sheet 422 completely overlaps the locking hole 44 and the limiting hole 24, as shown in FIG. 5. In this case, an anti-theft lock 93 including a limiting member 931 can further be used. The limiting member 931 sequentially runs through the locking hole 44, the hollow portion 4221 of the reinforcing sheet 422, and the limiting hole 24, and then is rotated, so that the limiting member 931 can incomplete overlap the locking hole 44, the hollow portion 4221 of the reinforcing sheet 422, and the limiting hole 24, to fix the clamping component 42, the hollow shell 43, and the fixing member 20. Furthermore, use of the anti-theft lock 93 can further avoid peeping. In another implementation, other buckles may alternatively be used to pass through the locking hole 44, the hollow portion 4221 of the reinforcing sheet 422, and the limiting hole 24 to achieve the limiting and stop functions, and are not limited to the anti-theft lock 93.

Furthermore, after the anti-theft lock 93 is locked, since the reinforcing sheet 422 is fixed, the clamping component 42 is fixed at the fixing position, and cannot move to the releasing position toward the +Y-axis direction. Moreover, since the pushing member 421 is fixed at the fixing position, as described above, the clamping member 423 correspondingly clamps the positioning member 10, so that the hollow shell 43 cannot move toward the −X-axis direction, and the hooks 41 of the cover 40 cannot be detached from the through hole 92 of the case 90. Furthermore, even if there is no reinforcing sheet 422, the limiting member 931 of the anti-theft lock 93 runs through the limiting hole 24 and the locking hole 44, and rotates relative to the fixing member 20 and the hollow shell 43 so that the limiting member 931 can incomplete overlap the locking hole 44 and the limiting hole 24 to lock the fixing member 20 and the hollow shell 43. Therefore, the cover 40 cannot be removed. Under the multiple fixing, the cover 40 can be firmly fixed to the case 90.

Referring to FIG. 2 and FIG. 4 together, in this embodiment, the hollow shell 43 further includes an opening 45 and a wire outlet 46. The opening 45 and the wire outlet 46 are respectively located on two opposite end faces of the hollow shell 43, and the six hooks 41 are disposed on the end face the same as the end face on which the opening 45 is located. When the cover 40 is assembled to the case 90, the opening 45 can prevent the hollow shell 43 from touching any wire or connection hole. The wire 91 is accommodated in the accommodating groove 31 and can extend to the outside of the cover 40 through the wire outlet 46.

In conclusion, after the wire 91 connected to the case 90 is accommodated and fixed by using the wire management member 30, even if the wire 91 is pulled by an external force or the case 90 is impacted, the wire management member 30 may first bear the external force rather than the connection between the wire 91 and the case 90, so that the wire 91 and the case 90 are not easily detached from each other, avoiding shutdown of the electronic device without warning or lose of the connection signal due to detachment of the wire 91 from the case 90

Moreover, the cover 40 is assembled to the case 90, so that the connection end between the wire 91 and the case 90 can be hidden in the cover 40. In addition, the cover 40 may be snap-fit to the case 90 by using the hook 41 disposed on the hollow shell 43 to achieve fixing and limiting in the direction perpendicular to the first direction, that is, the hollow shell 43 cannot be directly detached from the case by applying a force in the direction perpendicular to the first direction. Then, the pushing member 421 moves to the fixing position so that the clamping member 423 clamps the positioning member 10 to achieve fixing and limiting in the direction parallel to the first direction. The hooks 41 and the clamping component 42 are disposed, so that the hollow shell 43 is not easily separate from the case 90.

Although the application is described by using the embodiments above, the embodiments are not intended to limit the application. Any person of skilled in the similar technology may certainly make some variations and modifications without departing from the spirit and the scope of the application. Therefore, the protection scope of the application should be subject to the protection scope of the appended claims of the specification.

What is claimed is:

1. A securing module, applied to a case, comprising:

a positioning member, disposed on the case;

a fixing member, passed through the positioning member and fixed to the case;

a wire management member, disposed on the fixing member, wherein the wire management member comprises an accommodating groove for accommodating a wire; and a cover, assembled to the case, wherein the cover comprises at least one hook, a clamping component, and a hollow shell, the at least one hook and the clamping component are disposed on the hollow shell, the hollow shell covers the positioning member, the fixing member, and the wire management member, the clamping component is selectively moved between a fixing position and a releasing position, and when the at least one hook is snap-fit to the case and the clamping component is located at the fixing position, the clamping component clamps the positioning member so that the hollow shell is fixed to the case.

2. The securing module according to claim 1, wherein the fixing member comprises a body, a clamping portion, and an engaging groove, the body is passed through the positioning member and fixed to the case, the clamping portion and the engaging groove are connected to the body, the wire management member further comprises a buckle portion and an engaging portion, wherein the buckle portion is rotatably buckled to the clamping portion, and the wire management member is rotated, so that the engaging portion is placed in the engaging groove.

3. The securing module according to claim 1, wherein the fixing member and the wire management member are an integrally formed structure.

4. The securing module according to claim 1, wherein the at least one hook is an L-shaped hook, the case has at least one through hole, and the at least one hook is passed through the corresponding at least one through hole and moves toward a first direction, so that the at least one hook is snap-fit to the case.

5. The securing module according to claim 1, wherein the hollow shell comprises an opening and a wire outlet, the opening and the outlet are located on two opposite end faces of the hollow shell, the at least one hook is disposed on the end face the same as the end face on which the opening is located, and the wire is accommodated in the accommodating groove and runs through the wire outlet.

6. The securing module according to claim 1, wherein the clamping component comprises a pushing member and a clamping member, the hollow shell comprises a guide track, the pushing member runs through the guide track and abuts against the clamping member, and the pushing member is selectively moved between the fixing position and the releasing position, and drives the clamping member to move so that the clamping member clamps or is detached from the positioning member.

7. The securing module according to claim 6, wherein the clamping member has two clamping portions disposed in parallel, when the clamping member correspondingly clamps the positioning member, the two clamping portions respectively clamp two opposite sides of the positioning member.

8. The securing module according to claim 1, wherein the fixing member comprises a body and a limiting hole, the hollow shell has a locking hole, and when the cover is assembled to the case, the locking hole corresponds to the limiting hole.

9. The securing module according to claim 8, further comprising a limiting member, wherein the limiting member runs through the locking hole and the limiting hole and rotates relative to the fixing member and the hollow shell, so that the limiting member can incomplete overlap the locking hole and the limiting hole, to fix the hollow shell and the fixing member.

* * * * *